US005728429A

United States Patent [19]

Berrenberg et al.

[11] Patent Number: 5,728,429

[45] Date of Patent: Mar. 17, 1998

[54] METHOD AND A DEVICE FOR PRODUCING THIN LAYERS FROM LIQUIDS TO FORM COATING OR FOILS

[75] Inventors: Thomas Berrenberg, Kerkrade, Netherlands; Ingo Steinbach, Herzogenrath, Germany

[73] Assignee: Glyco-Metall-Werke Gkyco B.V. & Co. KG, Wiesbaden, Germany

[21] Appl. No.: 819,343

[22] Filed: Mar. 17, 1997

Related U.S. Application Data

[63] Continuation of Ser. No. 513,243, Aug. 10, 1995, abandoned.

[30] Foreign Application Priority Data

Aug. 13, 1994 [DE] Germany ..... 44 28 741.0

[51] Int. Cl.[6] ..... B05D 1/26

[52] U.S. Cl. ..... 427/345; 427/294; 427/356; 427/434.2; 427/434.5; 118/410

[58] Field of Search ..... 118/410; 427/356, 427/345, 294, 434.2, 434.3, 434.5

[56] References Cited

U.S. PATENT DOCUMENTS

| | | | |
|---|---|---|---|
| 3,496,012 | 2/1970 | Biorseth | 118/410 |
| 3,533,833 | 10/1970 | Takahashi et al. | 118/410 |
| 3,690,917 | 9/1972 | Hershoff et al. | 118/410 |

*Primary Examiner*—Katherine A. Bareford
*Attorney, Agent, or Firm*—Jon E. Shackelford

[57] ABSTRACT

A method and a device for producing thin layers from liquids to form coatings or foils. A substrate and a liquid application point are moved relative to each other and during the movement the liquid is applied at the application point onto the substrate, while forming a liquid strip, in an amount which is greater than is necessary for the formation of the liquid strip. The excess liquid is guided from the application point to the removal point against the outlet direction and the formed liquid strip is allowed to solidify.

8 Claims, 7 Drawing Sheets

METHOD AND A DEVICE FOR PRODUCING THIN LAYERS FROM LIQUIDS TO FORM COATING OR FOILS

This is a continuation of application Ser. No. 08/513,243 filed on Aug. 10, 1995, now abandoned.

BACKGROUND OF THE INVENTION

1. Field of the Invention

The present invention relates to a method for continuous production of thin layers from liquids to form coatings or foils, in which a substrate and a liquid application point are moved relative to each other. During the movement, the liquid is applied at the application point onto the substrate, while forming a liquid strip, in an amount which is greater than is necessary for the formation of the liquid strip. The excess liquid is drawn off at a removal point, and the liquid strip formed in the outlet direction is allowed to solidify. The invention also relates also to a flow applicator for the application of a liquid onto a substrate for the formation of such a thin layer according to the preamble of claim 11.

2. Description of Prior Developments

From DE 41 31 849 C1 discloses the continuous production of thin layers from liquids to form coating or foils, in which the liquid is supplied before the removal point. Before reaching the outlet channel the excess liquid is removed through the removal channel so that turbulence, generated in the upper liquid layers, is eliminated by the removed liquid. This method and the associated flow applicator enable qualitatively good layers to be produced.

It was found, however, that heat exchange between the melt and the substrate is not optimal. In this respect the danger of premature solidification of the melt is present which is harmful to the coating process.

SUMMARY OF THE INVENTION

The aim of the invention is to provide a method and device in which the heat exchange between the melt and the substrate is more uniform, the pressure control is simpler and the whole coating process proceeds in a more stable manner.

It was surprisingly found that the danger of premature solidification of the melt in the flow channel of the flow applicator and thereby disturbance of the coating process is reduced or even eliminated when the excess liquid is guided from the application point to the removal point against the outlet direction. By outlet direction is understood the direction in which the liquid proportion which forms the liquid strip flows out of the flow applicator. This means, that the liquid in the flow channel of the liquid applicator is caused to flow against the direction of movement of the substrate, when the latter moves, or, alternatively, in the direction of movement of the flow applicator when the substrate is stationary. A part of the liquid supplied in excess is immediately deflected in the region of the application point and is used for the formation of the liquid strip.

An advantage of the guiding of the liquid according to the invention in comparison with the liquid guiding known from DE 41 31 849 C1 resides in that the heat exchange between the melt and the substrate is much more uniform. A further advantage is that the pressure control of the process is simpler, because no means for creating vacuum in the removal channel are needed. The setting of the method parameters is more non-critical because the coating process is more stable.

The liquid is preferably supplied at the application point at an angle $\alpha \leqq 90°$ with respect to the liquid strip being formed. The thickness of the coating may be controlled by the setting of the angle $\alpha$. From this follow two variants of the method.

When choosing a coating thickness which is smaller than $d_2/2$ (where $d_2$ is the height of the outlet channel of the flow applicator) a vacuum P4, with respect to the ambient pressure, is established in the outlet channel behind the application point. This vacuum is preferably created by the setting of an acute angle $\alpha$ (preferably 30° to 60°). This enables formation of thin coatings having a thickness $\leqq 200$ μm with a very good layer quality.

When thick coating is desired such that the coating thickness is greater than or is equal to half the height $d_2$ of the outlet channel, the pressure P4 is set to be greater than or be equal to the ambient pressure. In order the create this overpressure, the angle $\alpha$ is set to have a value between 60° and 90°. With this may be produced coatings of a thickness >200 μm with a very high layer quality. Both when producing thin and thick layers the pressure P5 is set to be higher than the ambient pressure. Pressures P4 and P5 are coupled through the flow resistance in the flow channel of the flow applicator, so that the pressures are set through the design of the flow channel.

It was found that, when working with excess liquid, the quality of the coating is much improved, particularly as regards the constancy of the layer thickness.

Preferably, a twofold to tenfold amount of the liquid needed for the liquid strip is used. The excess liquid is drawn off at a removal point spaced from the application point and is from there preferably returned.

The improvement of the layer quality may be caused also in that no turbulence, which would result in thickness fluctuation, is caused by the liquid guiding according to the invention. The applied liquid is preferably guided between the application point and the removal point, at least in the region of contact between the substrate and the liquid, as a laminar flow. Turbulence might remain locally only in the region of contact of the liquid flow with the liquid strip and has no influence on the result of coating.

The flow applicator for the application of liquid onto a substrate in order to produce a thin layer is characterised in that the supply channel is arranged in the vicinity of the outlet channel and between the outlet and the removal channel. The supply channel makes with the outlet channel preferably an angle $\alpha \leqq 90°$.

To enable setting of different angles $\alpha$, an outlet delimiter is provided which includes a wedge-shaped end piece which delimits the outlet channel and the lower portion of the supply channel. The wedge-shaped end piece is removably fixed on the outlet delimiter. This makes it possible to use for the formation of thin layers a wedge-shaped end piece with an angle $\alpha$ of 30° to 60° and for thick coating with an angle $\alpha$>60° to 90°. When producing a thin coating the vacuum in the region behind the application point may be increased in that the supply channel is made to taper towards the application point and that the flow channel preferably widens from the application point to the removal point.

The pressure conditions according to the method in the region of the application point and in the region of the removal point may be adjusted by the choice of a suitable wedge-shaped end piece without the need for additional pressure means. Only a pump for the return is provided which communicates with the return channel.

A fine tuning of the pressure conditions in the flow channel may be achieved in that the bottom of the flow is structured in the region of the flow channel before the supply channel and after the removal channel. The bottom of the flow applicator has preferably before the supply channel and after the removal channel an upwardly retracted curved shape so that generation of a vacuum behind the supply point is promoted.

A particularly simple design of the flow applicator is obtained when a core is inserted inside it between the inlet delimiter and the outlet delimiter, which delimits the supply channel, the flow channel and the removal channel.

The distance ($d_1$) between the inlet delimiter and the surface of the substrate and the distance ($d_2$) between the outlet delimiter and the surface of the substrate may be firmly predetermined or the flow applicator may be disposed freely on the substrate, i.e. float on the liquid, so that $d_1$ and $d_2$ may adjust themselves according to the flow conditions and pressures. The flow applicator may also be fixed on a holder while being rotatably mounted either at the front or the rear end. The flow applicator then does not assume a parallel position with respect to the substrate. So as to optimise the flow, the flow applicator may be also fixed in such a way, that $d_2$ is variable.

BRIEF DESCRIPTION OF THE DRAWINGS

Embodiments of the invention will now be described, by way of example, in greater detail with reference to the drawings, in which.

DETAILED DESCRIPTION OF THE PREFERRED EMBODIMENTS

Figure 1:
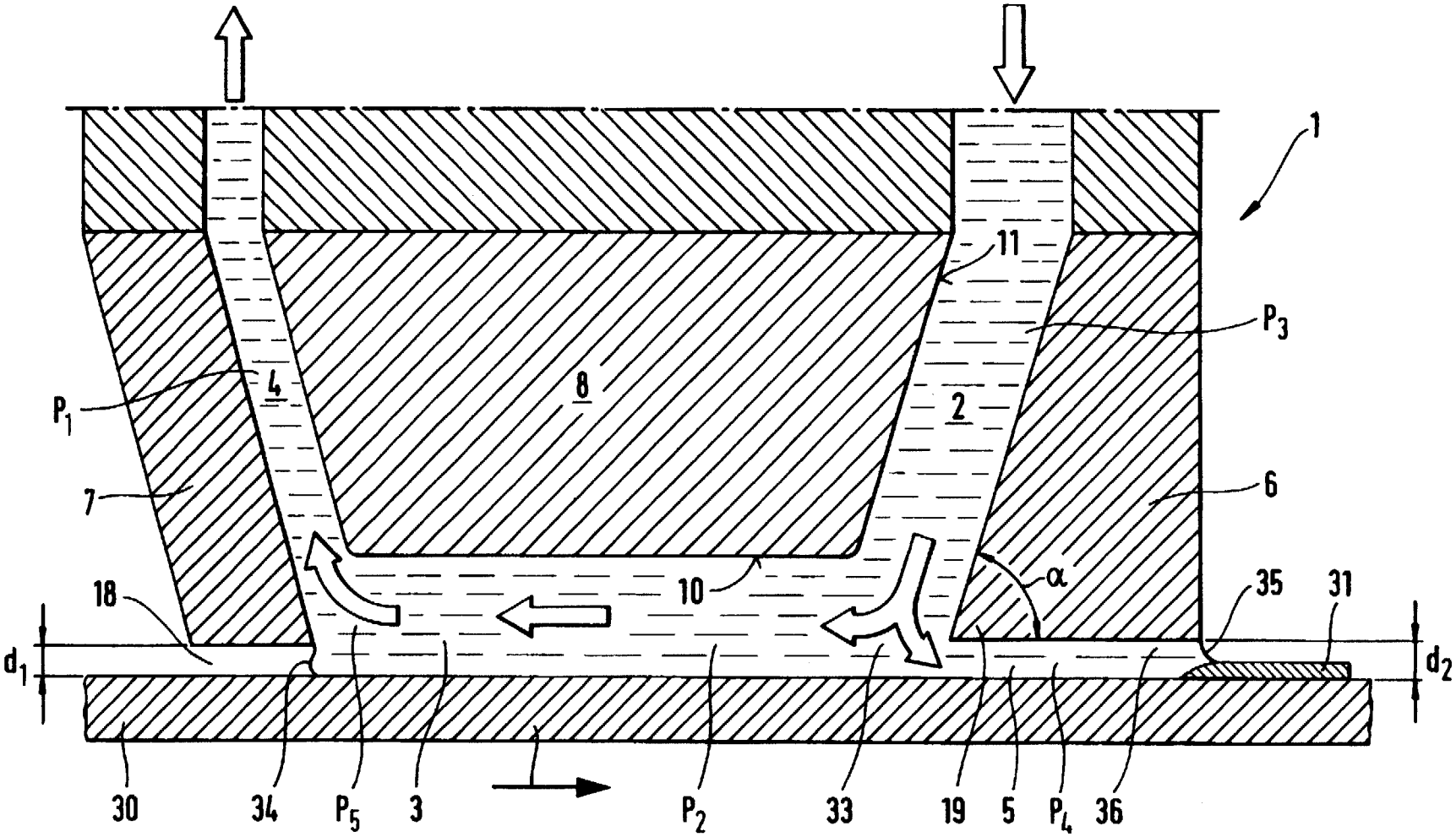
FIG. 1 is a longitudinal section through a flow applicator with a liquid and a substrate.

In FIG. 1 is shown diagrammatically in a longitudinal section a flow applicator 1 under which moves a strip-shaped substrate 30 in the direction shown by an arrow. The front side of the applicator 1 is formed by an inlet delimiter 7 which is inclined obliquely forwards and ends with a spacing $d_1$ over the substrate 30. Between the inlet delimiter 7 and the surface of the substrate 30 is thus defined a gap 18.

Between the inlet delimiter 7 and a core 8, which is situated inside the flow applicator, is defined a removal channel 4.

Between the bottom 10 of the core 8 and the substrate 30 is defined a flow channel 3 which interconnects a supply channel 2 with the removal channel 4. The supply channel 2 is delimited by the rear side 11 of the core 8 and an outlet delimiter 6.

The liquid for coating is applied from above through the supply channel 2 onto the substrate 30 at an application point where the stream of liquid divides. A smaller part of the liquid is deflected downstream into the outlet channel 5, and a greater part of the liquid flows upstream into the flow channel 3 where the excess amount of the liquid is drawn off or returned through the removal channel 4. The flow applicator 1 has also lateral walls which are not shown in FIG. 1 and which delimit the channels laterally.

The surface of the liquid in the region of the gap 18 is free and care must be taken to avoid entrapment of air between the liquid and the surface of the substrate. Entrapment of air is largely avoided if the liquid is so guided, as regards pressure, that an overpressure meniscus 34 is created. The pressure P1, and particularly the pressure P5, are so set, that they lie above the ambient pressure, whereby the liquid is slightly pressed into the gap 18 to create the overpressure meniscus 34. Naturally, the pressure P5 must not be set to be so high as to fill the gap 18 with liquid.

The liquid supplied in excess through the supply channel 2 has such a temperature, that optimum bonding of the layer on the substrate may be achieved. On its way from the branching point 33 to the removal channel 4 the liquid cools as it heats the substrate 30, so that the substrate has in the region of the outlet channel the temperature desired for optimum bonding of the layer. The cross-sectional area of the flow channel 3 and the cross-sectional area of the supply channel 2 are adapted to the amount of liquid necessary for the heating of the substrate 30, and are greater than the cross-sectional area of the outlet channel 5.

Because the liquid in the flow channel 3 is substantially guided by the surface of the substrate 30 and the bottom of the core 8, care must be taken that no turbulence is caused, which could have an adverse effect in the outlet channel 5 during the formation of the liquid strip 36.

Figure 7:
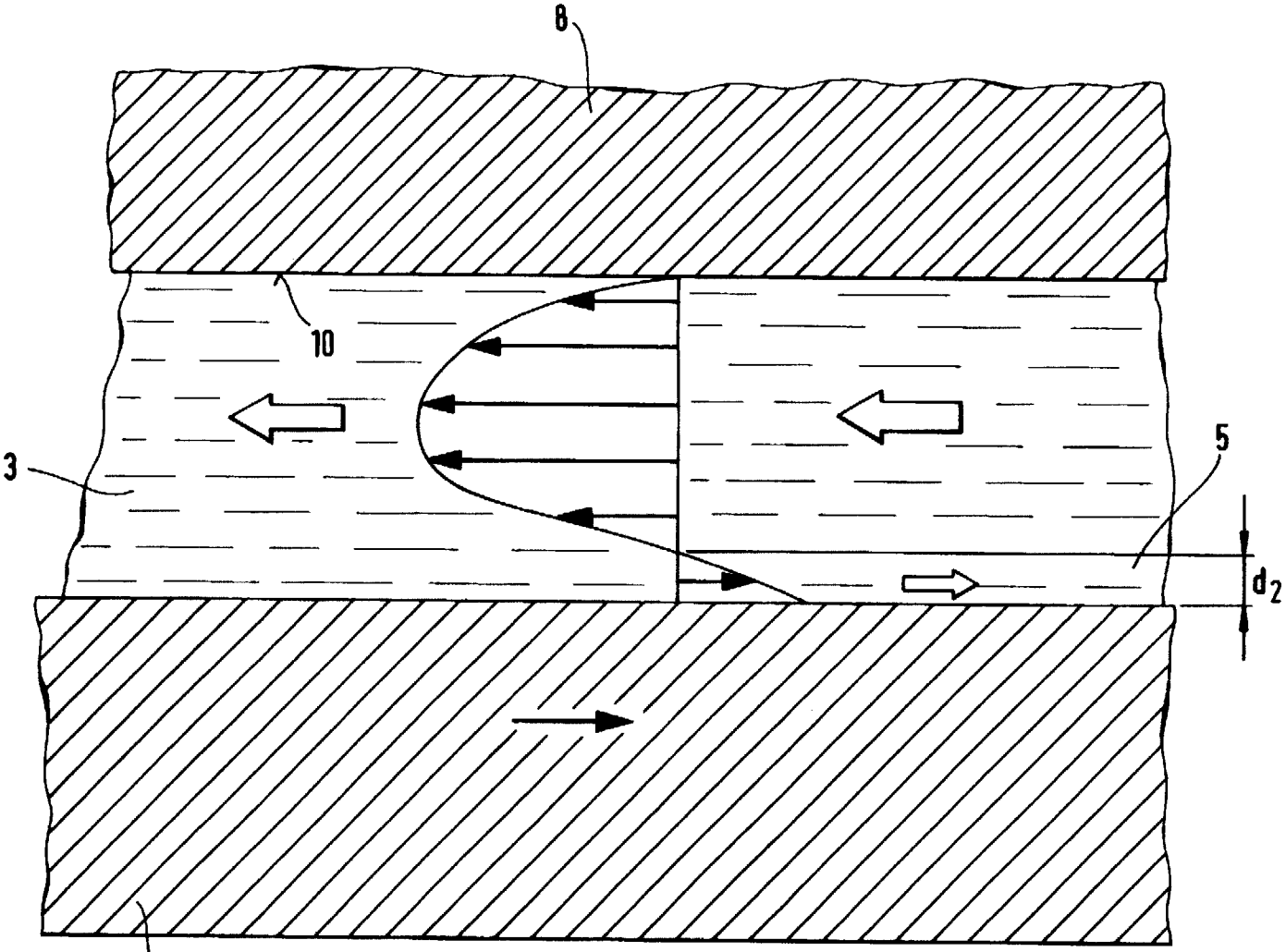
FIG. 7 is a representation of a flow profile in the flow channel.

The stream of liquid in the flow channel 3 is so adjusted, that laminar flow is obtained. The flow profile is shown in FIG. 7. The velocity gradient equals zero at such a distance over the substrate 30 which corresponds approximately to the height of the outlet channel 5. Below this height the velocity gradient becomes inverted.

Figure 2:
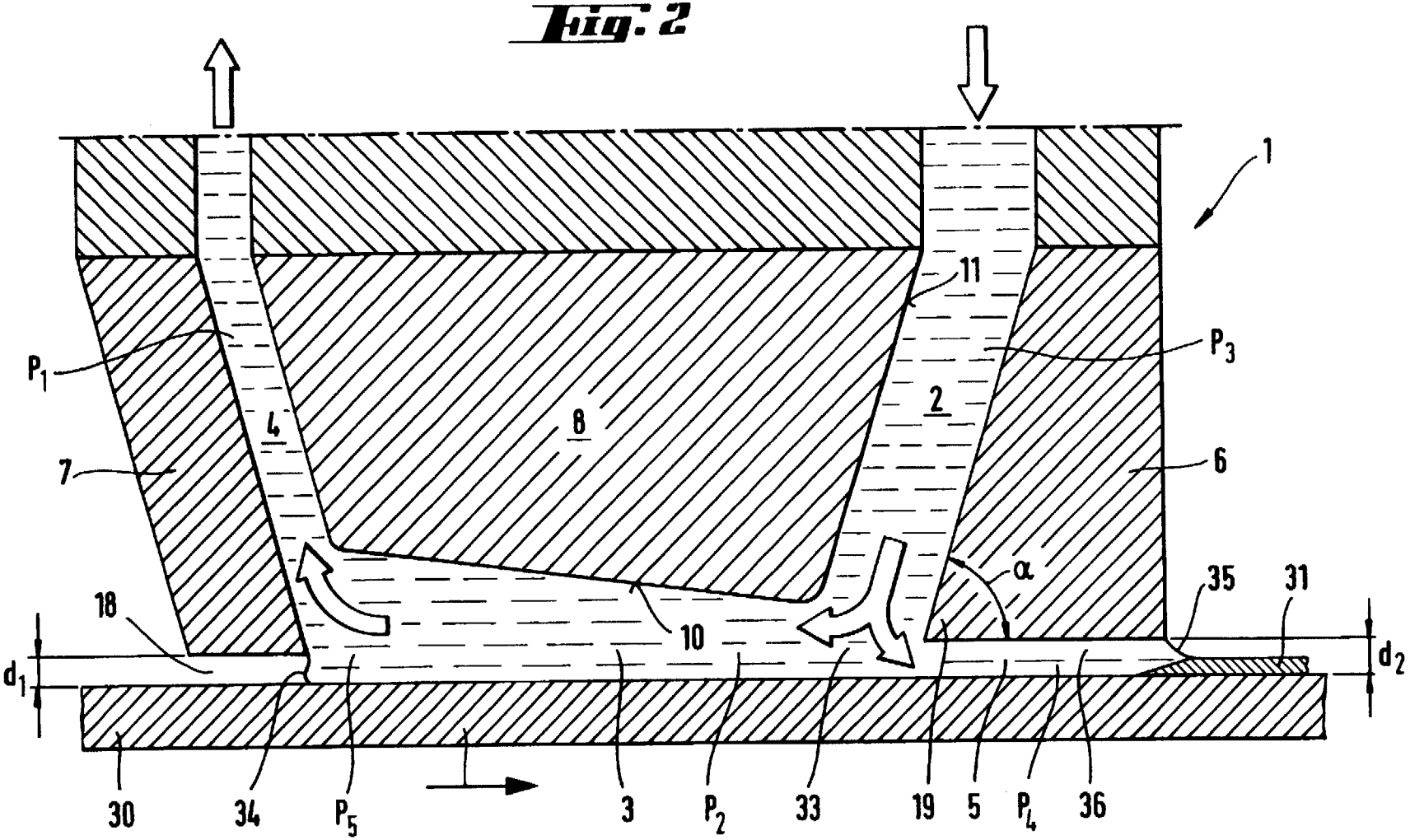
FIG. 2 is a partial longitudinal section through a flow applicator according to FIG. 1 having a supply channel of constant cross-section.
Figure 3:
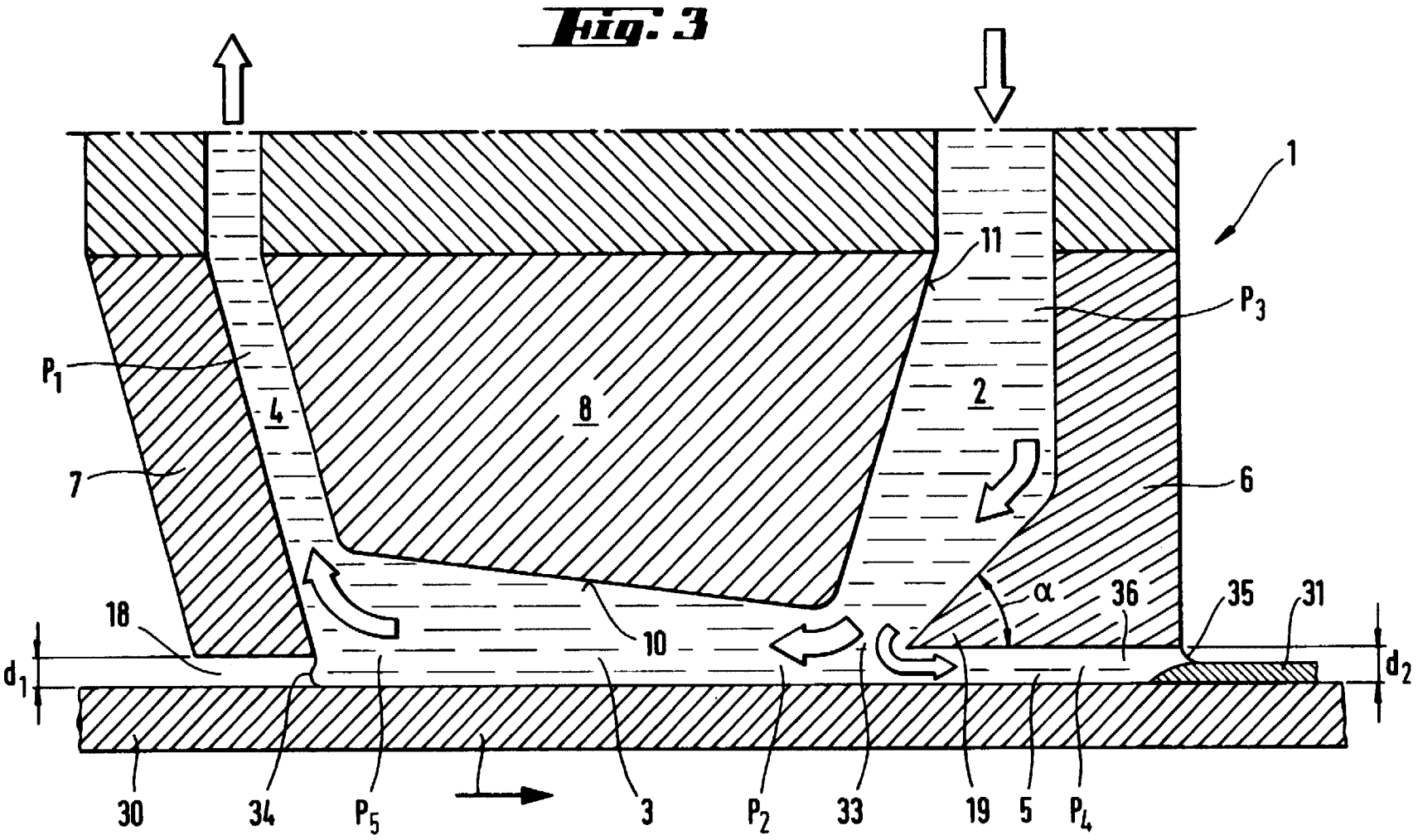
FIG. 3 is a partial longitudinal section through a flow applicator according to FIG. 1 having a tapering supply channel.

The outlet delimiter 6 comprises a wedge-shaped end piece 19 (see FIGS. 2 and 3) which is exchangeable. The wedge angle $\alpha$ according to FIG. 2 is greater than 60°, while the wedge angle $\alpha$ according to FIG. 3 is smaller than 60°. The exchangeability of the endpiece 19 enables the pressure conditions in the outlet channel 5 and in the flow channel to be correspondingly adjusted and so to be predetermined.

At the end of the wedge-shaped end piece 19 is created a film-forming meniscus 35 which transition into the solidified liquid strip 31.

Figure 4:
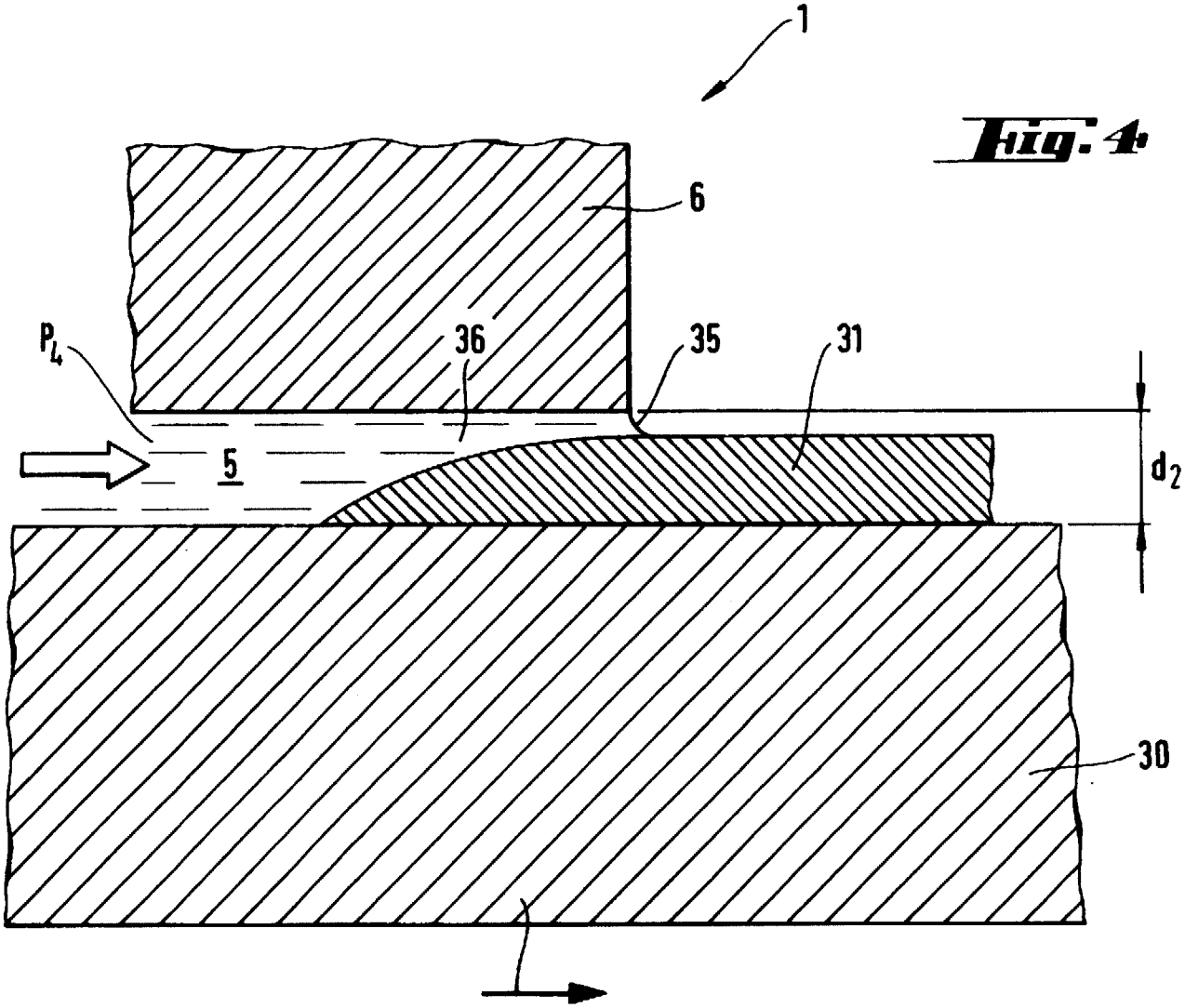
FIG. 4 is a section through the outlet channel with a solidifying liquid strip.

As is apparent from FIGS. 3 and 4, the portion of the liquid strip 31 which has already solidified extends into the outlet channel 5. Because the liquid strip has already partly solidified in the outlet channel 5, thickness fluctuations of the liquid strip 31 due to fluctuation of the meniscus are largely avoided, so that optimum quality of the liquid strip 31 may be achieved.

As is shown in FIG. 2, the supply channel has a constant cross-section. If the wedge-shaped endpiece 19 shown in FIG. 2 is replaced by the wedge-shaped endpiece 19 shown in FIG. 3, the smaller wedge angle $\alpha$ simultaneously causes tapering of the supply channel 2.

Figure 6:
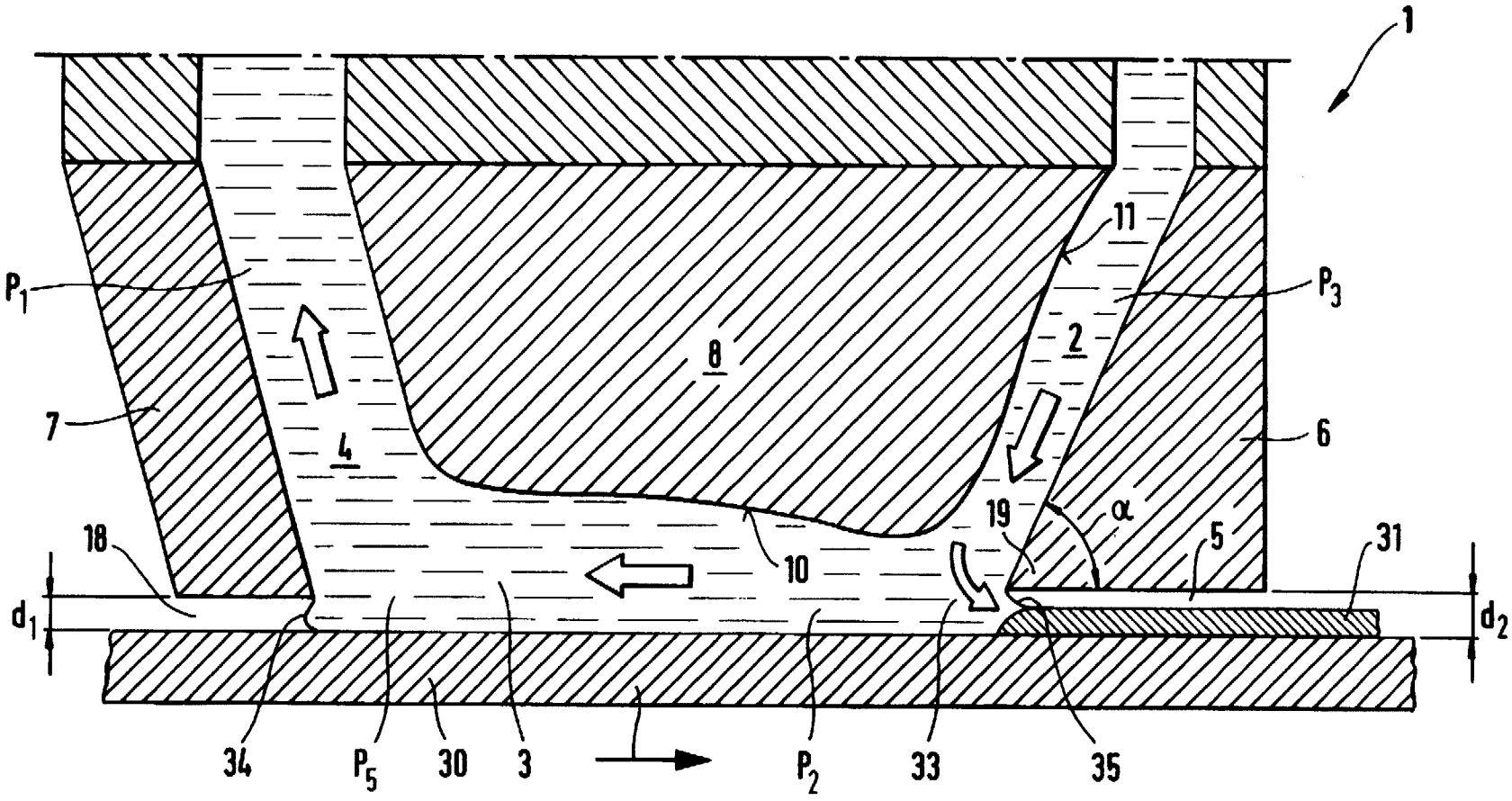
FIG. 6 is a flow applicator according to a further embodiment.

The flow channel 3 is both in FIG. 2 and FIG. 3 so designed that it widens in the direction toward the removal point. As shown in FIG. 6, the bottom of the core 8 may be for this purpose structured and the core may have an arched bottom 10.

Using the flow applicator according to FIG. 1 in which the outlet channel has a height $d_2$=0.5 mm, an aluminium-lead alloy ($AlPb_{10}$) was applied onto a substrate of lead bronze which was roughly ground. The velocity of the substrate was 1 m/s. The maximum temperature which a lead bronze can bear is close to the melting temperature of lead at about 325° C., while the homogenization temperature of the aluminium-lead alloy is about 1200° C.

The aluminium-lead alloy was supplied at a rate of 40 $cm^3/s$, from which 34 $cm^3/s$ was again drawn off, so that about a sevenfold excess amount of the liquid was used for the operation. The surface layer of the lead bronze in the region of the flow applicator was heated to a temperature of about 600° C., so that optimum bonding between the substrate and the aluminium-lead alloy was achieved. When using a flow applicator according to the state of the art, it is not possible, in the case when a liquid film of about 200 μ is applied, to obtain the temperature needed for the connection, because the thermal capacity of the thin liquid layer is insufficient. In order to produce a layer thickness <200 μm, the pressures were chosen as follows: P1=1.0 bar, P2=1.1 bar, P3=1.1 bar, P4=0.9 bar and P5=1.05 bar. For a thick coating, i.e. a thickness >200 μm, the pressures were chosen as follows: P1=1 bar, P2=1.1 bar, P3=1.15 bar, P4=1.1 bar and P5=1.05 bar.

Figure 5:
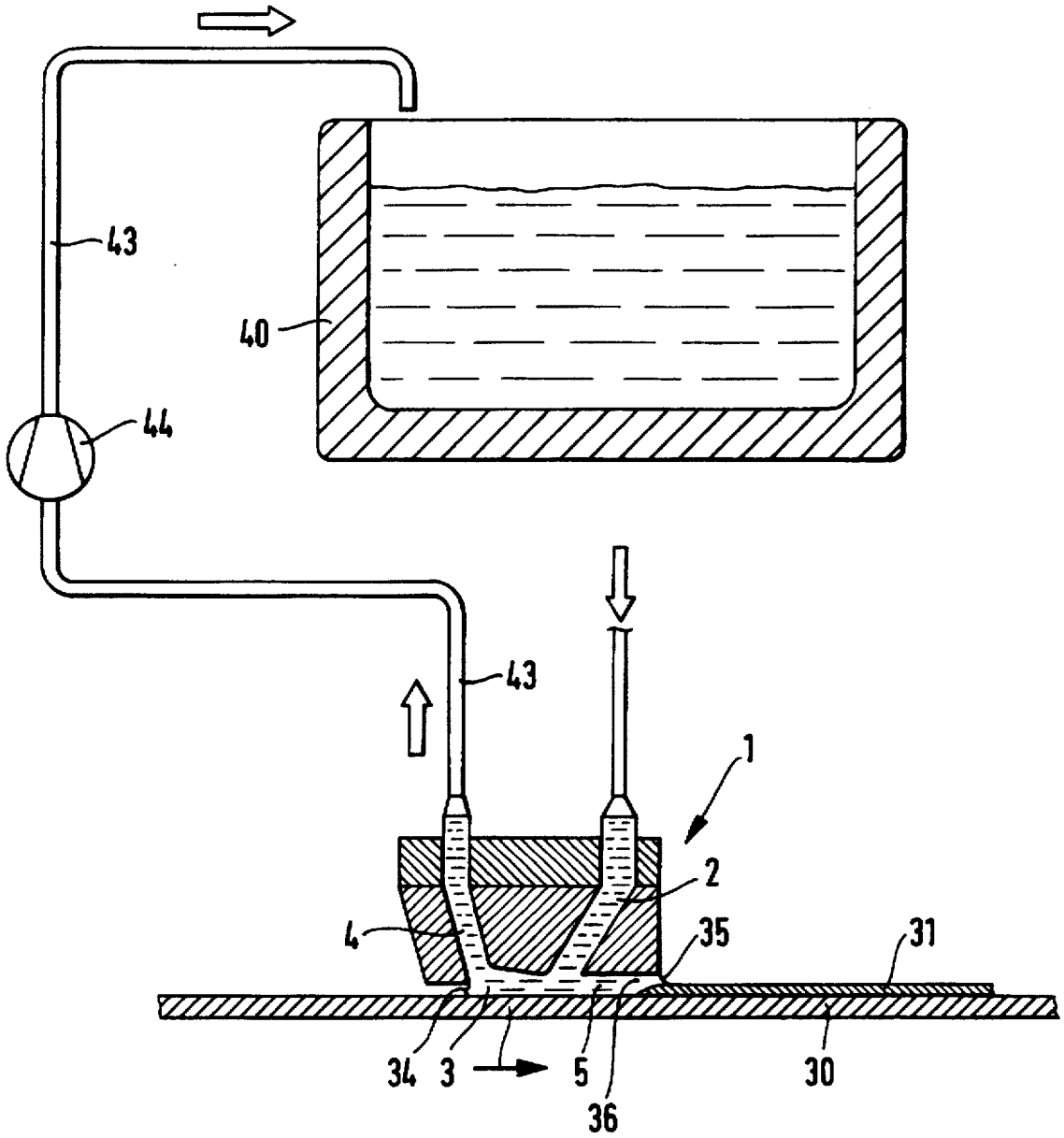
FIG. 5 is a diagrammatic representation of a flow applicator with an additional equipment.

As is shown in FIG. 5, the removal channel 4 communicates with a storage container 40 through a return pipe 43. For the returning is provided a pump 44 which, however, need not be used for the pressure adjustment in the flow applicator.

We claim:

1. A method for continuous production of thin layers from liquids to form coatings or foils, in which a substrate and a liquid application point are moved relative to each other, and in which, during the movement, the liquid is applied at the application point onto the substrate at an acute angle α between 30 degrees and 90 degrees, while forming a liquid strip, in an amount which is greater than is necessary for the formation of the liquid strip, the excess liquid is drawn off at a removal point, and the liquid strip formed on the substrate is directed through an outlet channel to an end exit and is allowed to solidify, and wherein the method comprises guiding the excess liquid from the application point to the removal point away from the outlet channel, maintaining the applied liquid adjacent the substrate between the application point and the removal point as a laminar flow and creating a film-forming meniscus with said liquid at said end exit of said outlet channel.

2. The method according to claim 1, wherein the liquid for the formation of the liquid strip is supplied at the application point at an angle $\alpha \leqq 60°$ with respect to the liquid strip being formed.

3. The method according to claim 1, wherein, in order to form layers of a thickness >200 μm, a pressure P greater than the ambient pressure is established in the liquid between the application point and the removal point.

4. The method according to claim 3, wherein a pressure P5 is set to be greater than the ambient pressure between said substrate and said removal point.

5. The method according to claim 1, wherein, in order to form layers of a thickness ≦200 μm, a pressure P4 lower than the ambient pressure is established in the liquid between the application point and the removal point.

6. The method according to claim 1, wherein the excess liquid is drawn off at the removal point spaced from the application point.

7. The method according to claim 1, wherein a twofold to tenfold amount of the liquid needed for the liquid strip is supplied at the liquid application point.

8. The method according to claim 1, wherein the excess liquid is recycled.

* * * * *